United States Patent [19]

Matthews et al.

[11] 4,386,918

[45] Jun. 7, 1983

[54] TROLLING MOTOR STEERING DEVICE

[76] Inventors: Carol L. Matthews, 532 S. Woodland Dr.; Bill R. Chavez, Sr., 312 E. Mohr La., both of Mustang, Okla. 73064

[21] Appl. No.: 282,780

[22] Filed: Jul. 13, 1981

[51] Int. Cl.[3] ..... B63H 25/00

[52] U.S. Cl. ..... 440/7; 114/153; 440/63

[58] Field of Search ..... 280/265; 440/53, 63, 440/6, 7; 114/144 R, 153

[56] References Cited

U.S. PATENT DOCUMENTS

| | | | |
|---|---|---|---|
| 2,633,096 | 3/1953 | Rayfield | 114/153 |
| 2,960,057 | 11/1960 | Taylor | 440/6 |
| 3,288,099 | 11/1966 | Bittner | 114/153 |
| 3,371,641 | 3/1968 | Rohman | 114/153 |
| 3,807,345 | 4/1974 | Peterson | 440/7 |
| 4,143,436 | 3/1979 | Jones | 440/7 |

*Primary Examiner*—Sherman D. Basinger
*Attorney, Agent, or Firm*—Robert K. Rhea

[57] ABSTRACT

A foot pedal bar is horizontally secured medially its ends to the vertical shaft of an outboard electric trolling motor mounted on the forward end of a fishing float. A control switch, supported by the pedal bar, operates the motor.

2 Claims, 3 Drawing Figures

TROLLING MOTOR STEERING DEVICE

BACKGROUND OF THE INVENTION

1. Field of the Invention

The present invention relates to trolling motors drivably mounted on a bass fishing float and more particularly to a trolling motor propeller guide for steering the float.

Conventional one-man bass fishing floats are provided with a battery powered trolling motor, mounted on a vertical shaft, having a propeller on its depending end and angularly rotatably mounted on the float at the forward end thereof for guiding the float in accordance with the position of the propeller. The occupant of the float faces the trolling motor and heretofor guides the propeller by a rearwardly projecting handle secured to the motor housing. However, this has the disadvantage that if the fishing float is in motion, when a fish strikes the bait, the fisherman needs both hands to handle the rod and reel.

This invention provides a foot pedal guide for the trolling motor which frees both hands of the fisherman.

2. Description of the Prior Art

The prior art generally discloses a foot steering apparatus for outboard motors mounted on the rearward end of boats in which a pedal bar, pivotally mounted on or above the floor at the front end portion of the boat, is connected with the outboard motor by cables entrained over pulleys, or the like, for angular partial rotation of the motor about its vertical axis in response to foot pressure applied to respective ends of the pedal bar.

This invention is distinctive over prior patents by mounting the foot pedal guide on the motor and propeller drive shaft thus eliminating the entire cable and pulley mechanism.

SUMMARY OF THE INVENTION

An elongated bar is rigidly clamped horizontally medially its ends to the vertical shaft of a battery powered trolling motor above the position of the mounting clamp connecting the trolling motor with a fishing float transom. The respective end portions of the bar form foot pedals for horizontal to and fro swinging movement of the bar about the vertical axis of the shaft. One of the pedals supports a switch bar having a heel supporting clip at its depending end and a push button switch mounted on its upper end portion for opening and closing the circuit to the electric trolling motor.

The principal object of this invention is to provide a foot operated guide for steering the propeller of a trolling motor mounted on a fishing float to free the hands of the operator.

DESCRIPTION OF THE PREFERRED EMBODIMENT

Figure 1:
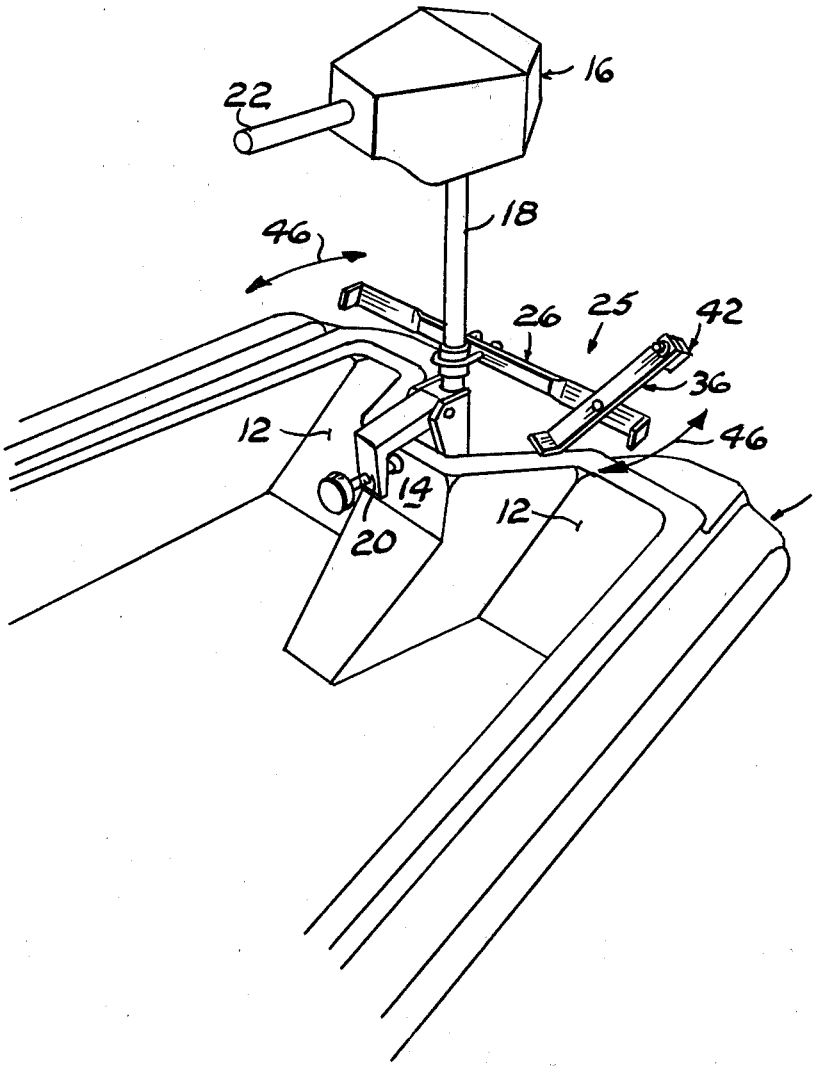
FIG. 1 is a fragmentary perspective view of one end portion of a fishing float having an electric trolling motor mounted thereon illustrating the relative position of the trolling motor guide.

Like characters of reference designate like parts in those figures of the drawings in which they occur.

In the drawings:

The reference numeral 10 indicates the forward end portion of a conventional one-man bass fishing float, having a pair of forwardly and upwardly inclined foot rests 12 disposed forwardly of a chair-like seat, not shown, supported by the float and on opposing sides of a transom 14. A conventional trolling motor 16, having a vertical shaft 18 and a support clamp 20, secured thereto for mounting the trolling motor on the transom 14, with a propeller, not shown, secured to the depending end of the shaft, below the lower limit of the float, is mounted on the float 10. The housing of the motor 16 is provided with a rearwardly projecting handle 22 for hand guiding the float by angularly rotating the motor and propeller, to and fro, about the vertical axis of the shaft 18.

The above description is set forth to show the combination with which the present invention is used, and as mentioned hereinabove eliminates the need for hand guiding the trolling motor.

The numeral 25 indicates the device comprising an elongated strap metal bar 26 horizontally secured medially its ends by a U-bolt 28 to the shaft 18 above the position of the motor mounting clamp 20. The length of the bar 26 is such that its respective end portions are disposed in spaced relation above the position of the float foot rests 12. The respective end portion of the bar 26 is twisted about its longitudinal axis, as at 30, to form foot pedal end portions 32 with the transverse plane thereof inclined forwardly and upwardly for flat contact with the sole of the user's shoe, not shown. A short length of the respective foot pedal end portion is bent or turned rearwardly substantially normal to the plane of the respective pedal 32 to form clip ends 34 and assist the user in maintaining his feet in contact with the pedals 32 when guiding the float.

One of the pedals, for example, the right pedal, as viewed in the drawings, is provided with a switch bar 36 comprising a short length of similar strap iron, having a length not greater than the length of the user's foot, which is connected, as by a rivet 38, medially its ends to the central portion of the pedal 32.

The switch bar 36 is preferably inclined outwardly at its upper end away from the axis of the motor shaft 18. The depending end portion of the switch bar 36 is turned rearwardly at right angle to form a heel clip 40 for supporting the user's foot when in contact with the switch bar 36.

Figure 3:
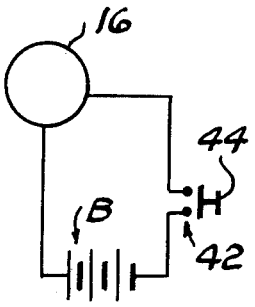
Figure 2:
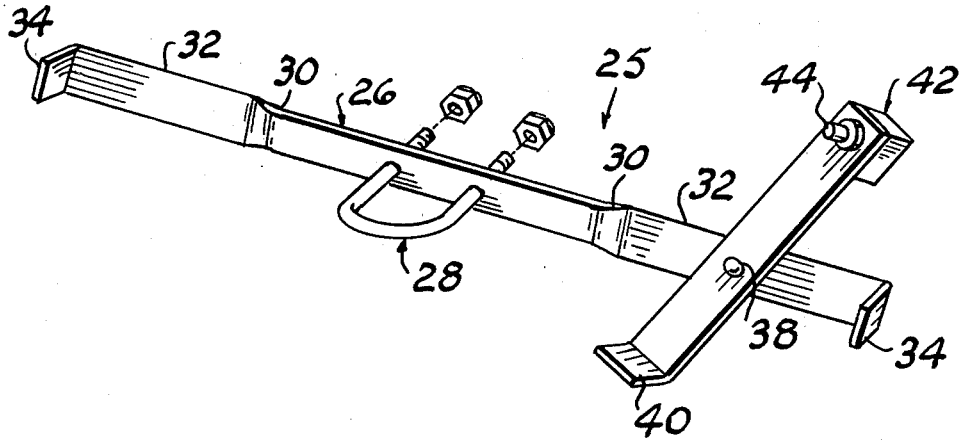
FIG. 2 is a perspective view, to a larger scale, of the guiding device, per se; and, FIG. 3 is a wiring diagram.

The upper end portion of the switch bar supports a push button switch 42 with the switch actuator or button 44 projecting through the switch bar and contacted by the sole of the user's shoe. The push button switch is preferably of the type that, when the button is pushed, it completes a circuit from a battery B to the trolling motor 16 (FIG. 3) and when released opens the circuit to stop the motor.

OPERATION

Operation of the device seems obvious but briefly stated and assuming the device 25 is installed as described hereinabove, the operator, seated on the float 10, on a body of water, places his feet on the foot pedals 32 and by foot pressure on the switch button 44 energizes the motor 16. The float is guided by foot pressure applied to one or the other of the pedals to swing the device 25 horizontally in the direction of the arrows 46 about the axis of the motor shaft 18 so that the position of the propeller drives the float in the desired direction.

Releasing foot pressure from the push button 44 stops the motor and propeller while the heel clip 40 supports the user's foot in position for again closing the switch when desired.

Obviously the invention is susceptible to changes or alterations without defeating its practicability. Therefore, we do not wish to be confined to the preferred embodiment shown in the drawings and described herein.

We claim:

1. In a fishing float having an electric outboard trolling motor mounted by its vertical shaft on the forward end of the float for swingable movement of the motor about the axis of the vertical shaft and guiding the float, the improvement comprising:

foot steering means comprising an elongated strap metal bar horizontally secured medially its ends to said vertical shaft above the upper limit of said float, said bar being vertically disposed edgewise and further characterized by being twisted about its longitudinal axis adjacent its respective end portions to form a pair of foot pedals terminating at the respective ends of the bar in a rearwardly projecting foot retaining clip portion;

a generally vertical switch bar transversely secured intermediate its ends to one said foot pedal, said switch bar having a rearwardly projecting heel support clip at its depending end; and, a trolling motor control switch mounted on the upper end portion of said switch bar.

2. The combination according to claim 1 and further including:

clamp means for securing said elongated bar to said vertical shaft.

* * * * *